US006034040A

United States Patent [19]

Ozbalik et al.

[11] Patent Number: 6,034,040

[45] Date of Patent: Mar. 7, 2000

[54] LUBRICATING OIL FORMULATIONS

[75] Inventors: Nubar Ozbalik; Sanjay Srinivasan; Vincent James Gatto, all of Midlothian, Va.

[73] Assignee: Ethyl Corporation, Richmond, Va.

[21] Appl. No.: 09/128,156

[22] Filed: Aug. 3, 1998

[51] Int. Cl.[7] ..... C10M 145/14; C10M 143/00

[52] U.S. Cl. ..... 508/469; 585/13

[58] Field of Search ..... 508/469; 585/13

[56] References Cited

U.S. PATENT DOCUMENTS

| | | | |
|---|---|---|---|
| 3,772,196 | 11/1973 | St. Clair et al. | 585/13 |
| 4,031,020 | 6/1977 | Sugiura et al. | 252/56 R |
| 4,758,364 | 7/1988 | Seki et al. | 508/469 |
| 4,853,139 | 8/1989 | Ichihashi | 508/469 |
| 5,372,703 | 12/1994 | Kamiya et al. | 585/13 |
| 5,858,932 | 1/1999 | Dasai et al. | 585/13 |
| 5,888,946 | 3/1999 | Zakarian et al. | 508/469 |

FOREIGN PATENT DOCUMENTS

281060 B1 6/1993 European Pat. Off. .

790294 A2 8/1997 European Pat. Off. .

OTHER PUBLICATIONS

O'Connor, et al.—Axle Efficiency—Response to Synthetic Lubricant Components, SAE paper No. 821181–1982 Month Unavailable.

*Primary Examiner*—Jacqueline V. Howard
*Attorney, Agent, or Firm*—Dennis Rainear; Thomas Hamilton

[57] ABSTRACT

Lubricating oil compositions having excellent thermal and oxidative stability, wear control, copper corrosion control and compatibility with seal materials comprising a mineral oil having a) a Viscosity Index of greater than 110 and an aniline point of greater than 110° C. and/or b) a linear+single ring paraffin content of greater than 68 wt %, and at least one polymer selected from olefin (co) polymer(s), polyalkyl (meth) acrylate(s) and mixtures thereof. The lubricating oil compositions are particularly useful as manual transmission and axle lubricants.

50 Claims, No Drawings

LUBRICATING OIL FORMULATIONS

TECHNICAL FIELD

This invention relates to novel lubricating oil compositions having excellent thermal and oxidative stability, low temperature viscometrics, wear control, copper corrosion control and compatibility with seal materials. The lubricating oil compositions are particularly useful as manual transmission and axle lubricants.

BACKGROUND INFORMATION

It is widely believed in the industry that certain levels of oxidative and thermal stability in lubricant oils can only be obtained by using full synthetic formulations. It is an object of the present invention to obtain performance similar to a full synthetic formulation using mineral base oils in order to recognize the significant cost difference between expensive synthetic base oils and less expensive mineral base oils.

In a paper by O'Connor et al., entitled *Axle Efficiency—Response to Synthetic Lubricant Components* (SAE Paper No. 821181), the authors state that "[i]nvestigations with both partial- and full-synthetic base formulations have shown improvements compared to conventional petroleum base gear oils. Maximum benefits are gained with total synthetic base type formulations." This paper fails to teach the advantages obtained by the mineral based lubricating oil formulations of the present invention.

U.S. Pat. No. 4,758,364 is directed to an automatic transmission fluid comprising either a mineral or synthetic oil, $C_2$–$C_{10}$ monoolefin polymers, and methacrylic acid ester copolymers. This patent does not teach or suggest the specific mineral oil of the present invention.

U.S. Pat. No. 4,853,139 is directed to lubricating oil compositions comprising a base oil having a kinematic viscosity at 100° C. of 1.5 to 50 cSt, a pour point of −25° C. or lower and a viscosity index of at least 60; an ethylene-α-olefin copolymer having a number average molecular weight of 1,000 to 8,000; and at least one additive selected from an extreme pressure agent, an anti-wear agent, an oiliness agent and a detergent dispersant. This reference fails to teach the specific mineral oils of the present invention.

EP 0281060 B1 is directed to lubricating oil compositions for traction drives comprising a specific base oil; an ethylene-α-olefin copolymer having a number average molecular weight of 800 to 8,000; a polymethacrylate having a number average molecular weight of 10,000 to 100,000; and an anti-wear agent. This reference fails to teach the specific mineral oils of the present invention.

EP 0790294 A2 is directed to lubricating oil compositions comprising a base oil; 5 to 30 wt % of at least one polymer having a weight average molecular weight of less than 10,000; and 2 to 12 wt % of a polymer having a weight average molecular weight of greater than about 15,000. This reference fails to teach the specific mineral oils of the present invention or recognize the benefits obtained by the specific combinations of the present invention.

SUMMARY OF THE INVENTION

The present invention is directed to a lubricating oil composition comprising:

(A) a mineral oil having a) a Viscosity Index of greater than 110 and an aniline point of greater than 110° C. and/or b) a linear+single ring paraffin content of 68 wt % or greater;

(B) from about 0.1 to about 40 weight percent, based on the total weight of the lubricating oil composition, of at least one polymer selected from the group consisting of olefin (co) polymer(s), polyalkyl (meth) acrylate(s) and mixtures thereof;

(C) from 2 to 25 weight percent, based on the total weight of the lubricating oil composition, of a detergent/inhibitor package.

DETAILED DESCRIPTION OF THE INVENTION

The present invention is directed to a lubricating oil composition comprising:

(A) a mineral oil having a) a Viscosity Index of greater than 110 and an aniline point of greater than 110° C. and/or b) a linear+single ring paraffin content of 68 wt % or greater;

(B) from about 0.1 to about 40 weight percent, based on the total weight of the lubricating oil composition, of at least one polymer selected from the group consisting of olefin (co) polymer(s), polyalkyl (meth) acrylate(s) and mixtures thereof;

(C) from 2 to 25 weight percent, based on the total weight of the lubricating oil composition, of a detergent/inhibitor package.

In one embodiment, the mineral oil (A) of the present invention is a hydrotreated, hydrocracked and/or isodewaxed mineral oil having a Viscosity Index of greater than 110, preferably between 110 and 135, most preferably between 110 and 120, and an aniline point of greater than 110° C., preferably between 110 and 126.

In another embodiment, the mineral oil (A) of the present invention is a hydrotreated, hydrocracked and/or isodewaxed mineral oil having a linear+single ring (i.e., non-condensed cycloparaffin) paraffin content of 68 wt % or greater, as determined by the analytical technique set forth in the paper by C. J. Robinson entitled Low-Resolution Mass Spectrometric Determination of Aromatics and Saturates in Petroleum Fraction (Analytical Chemistryr, Vol. 43, No. 11, September 1971, pp. 1425–1434). This mass spectrometric procedure is useful for determining up to 25 saturated and aromatic compound types in petroleum fractions.

The mineral oil (A) is present in an amount of from 40 to 93 weight percent, preferably 55 to 80 weight percent, based on the total weight of the lubricating oil composition.

The polymers suitable for use as component (B) of the present invention include at least one polymer selected from the group consisting of olefin (co) polymer(s), polyalkyl (meth) acrylate(s) and mixtures thereof. Preferably, component (B) comprises a mixture of polymers comprising (b') at least one olefin (co) polymer and (b") at least one polyalkyl (meth) acrylate in a ratio of b':b" of from 20:1 to 1:2. In a preferred embodiment, the fully formulated oil contains 0.1 to 40 wt % olefin (co) polymer and 0.1 to 20 wt % polyalkyl (meth) acrylate. More preferably, 12 to 20 wt % olefin (co) polymer and 1 to 6 wt % polyalkyl (meth) acrylate.

The olefin (co) polymer useful in the present invention is a homopolymer or copolymer resulting from the polymerization of $C_2$–$C_{10}$ olefins and having a number average molecular weight of from 1,000 to 10,000, preferably 1,000 to 3,000, as determined by gel permeation chromatography (GPC). The $C_2$–$C_{10}$ olefins include ethylene, propylene, 1-butene, isobutylene, 2-butene, 1-octene and 1-decene. Preferred (co) polymers include polypropylene, polyisobutylene, ethylene/propylene copolymers and 1-butene/isobutylene copolymers. Polyisobutylene is the most preferred olefin polymer.

The polyalkyl (meth) acrylates suitable for use in the present invention are prepared by the polymerization of $C_1$–$C_{30}$ (meth) acrylates. Preparation of these polymers may further include the use of acrylic monomers having nitrogen-containing functional groups, hydroxy groups and/or alkoxy groups which provide additional properties to the polyalkyl (meth) acrylates such as improved dispersancy. The polyalkyl (meth) acrylates preferably have a number average molecular weight of from 10,000 to 250,000, preferably 20,000 to 200,000. The polyalkyl (meth) acrylates may be prepared by conventional methods of free-radical or anionic polymerization.

The detergent/inhibitor (DI) package useful in the present invention may contain one or more conventional additives selected from the group consisting of dispersants, fluidizing agents, friction modifiers, corrosion inhibitors, rust inhibitors, antioxidants, detergents, seal swell agents, extreme pressure additives, anti-wear additives, pour point depressants, deodorizers, defoamers, demulsifiers, dyes and fluorescent coloring agents. The DI package is present in an amount of from 2 to 25 weight percent, based on the total weight of the lubricating oil composition.

The dispersants useful in the present invention comprise at least one oil-soluble ashless dispersant having a basic nitrogen and/or at least one hydroxyl group in the molecule. Suitable dispersants include alkenyl succinimides, alkenyl succinic acid esters, alkenyl succinic ester-amides, Mannich bases, hydrocarbyl polyamines, or polymeric polyamines.

The alkenyl succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to, for example, about 180–220° C. The olefin is preferably a polymer or copolymer of a lower mono-olefin such as ethylene, propylene, 1-butene, isobutene and the like and mixtures thereof. The more preferred source of alkenyl group is from polyisobutene having a gel permeation chromotography (GPC) number average molecular weight of up to 10,000 or higher, preferably in the range of about 500 to about 2,500, and most preferably in the range of about 800 to about 1,200.

As used herein the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

Alkenyl succinic acid esters and diesters of polyhydric alcohols containing 2–20 carbon atoms and 2–6 hydroxyl groups can be used in forming the phosphorus-containing ashless dispersants. Representative examples are described in U.S. Pat. Nos. 3,331,776; 3,381,022; and 3,522,179. The alkenyl succinic portion of these esters corresponds to the alkenyl succinic portion of the succinimides described above.

Suitable alkenyl succinic ester-amides for forming the phosphorylated ashless dispersant are described for example in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Hydrocarbyl polyamine dispersants that can be phosphorylated are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000 as determined by GPC, more usually in the range of about 1,000–5,000, and is derived from a suitable polyolefin. Preferred hydrocarbyl-substituted amines or polyamines are prepared from polyisobutenyl chlorides and polyamines having from 2 to about 12 amine nitrogen atoms and from 2 to about 40 carbon atoms.

The Mannich base dispersants are preferably a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable as the ashless dispersants of the present invention are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

The various types of ashless dispersants described above can be phosphorylated by procedures described in U.S. Pat. Nos. 3,184,411; 3,342,735; 3,403,102; 3,502,607; 3,511,780; 3,513,093; 3,513,093; 4,615,826; 4,648,980; 4,857,214 and 5,198,133.

The dispersants of the present invention may be boronated. Methods for boronating (borating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

Preferred procedures for phosphorylating and boronating ashless dispersants such as those referred to above are set forth in U.S. Pat. Nos. 4,857,214 and 5,198,133.

The amount of ashless dispersant on an "active ingredient basis" (i.e., excluding the weight of impurities, diluents and solvents typically associated therewith) is generally within the range of about 0.5 to about 7.5 weight percent (wt %), typically within the range of about 0.5 to 5.0 wt %, preferably within the range of about 0.5 to about 3.0 wt %, and most preferably within the range of about 2.0 to about 3.0 wt %, based on the finished oil.

Fluidizing agents may be used in the present invention. Suitable fluidizing agents include oil-soluble diesters. The preferred diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

Other esters which may give generally equivalent performance are polyol esters such as Emery 2918, 2939 and 2995 esters from the Emery Group of Henkel Corporation and Hatcol 2926, 2970 and 2999.

For certain applications it may be desired to use one or more friction modifiers in preparing the finished lubricating oil formulation. Suitable friction modifiers include such compounds as aliphatic amines or ethoxylated aliphatic amines, aliphatic fatty acid amides, aliphatic carboxylic acids, aliphatic carboxylic esters, aliphatic carboxylic esteramides, aliphatic phosphonates, aliphatic phosphates, aliphatic thiophosphonates, aliphatic thiophosphates, or mixtures thereof. The aliphatic group typically contains at least about eight carbon atoms so as to render the compound suitably oil soluble. Also suitable are aliphatic substituted succinimides formed by reacting one or more aliphatic succinic acids or anhydrides with ammonia.

One preferred group of friction modifiers is comprised of the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms.

Preferred friction modifier mixtures include a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms. Further details concerning this friction modifier system are set forth in U.S. Pat. Nos. 5,372,735 and 5,441,656.

Another preferred mixture of friction modifiers is based on the combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms. For further details concerning this friction modifier system, reference should be had to U.S. Pat. No. 5,344,579.

Another class of friction modifiers that may be used in the present invention include compounds of the formula:

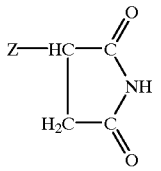

or

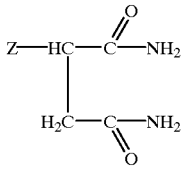

in which Z is a group $R_1R_2CH$—, in which $R_1$ and $R_2$ are each independently straight- or branched- chain hydrocarbon groups containing from 1 to 34 carbon atoms and the total number of carbon atoms in the groups $R_1$ and $R_2$ is from 11 to 35. The radical Z may be, for example, 1-methylpentadecyl, 1-propyltridecenyl, 1-pentyltridecenyl, 1-tridecenylpentadecenyl or 1-tetradecyleicosenyl. Preferably, the number of carbon atoms in the groups $R_1$ and $R_2$ is from 16 to 28 and more commonly 18 to 24. It is especially preferred that the total number of carbon atoms in $R_1$ and $R_2$ is about 20 to 22. A preferred friction modifier is the succinimide shown, the preferred succinimide being a 3–$C_{18-24}$ alkenyl-2,5-pyrrolidindione, i.e. a compound in which the average number of carbon atoms in the alkenyl group is from 18 to 24.

These compounds are commercially available or may be made by the application or adaptation of known techniques (see, for example, EP 0020037 and U.S. Pat. Nos. 5,021,176, 5,190,680 and RE-34,459 incorporated herein by reference).

The use of friction modifiers is optional. However, in applications where friction modifiers are used, the compositions of this invention will contain up to about 1.25 wt %, and preferably from about 0.05 to about 1 wt % of one or more friction modifiers.

The lubricant compositions of the present invention typically will contain some inhibitors. The inhibitor components serve different functions including rust inhibition, corrosion inhibition and foam inhibition. The inhibitors may be introduced in a pre-formed additive package that may contain in addition one or more other components used in the compositions of this invention. Alternatively these inhibitor components can be introduced individually or in various subcombinations. While amounts can be varied within reasonable limits, the finished fluids of this invention will typically have a total inhibitor content in the range of about 0 to about 15 wt %, on an "active ingredient basis", i.e., excluding the weight of inert materials such as solvents or diluents normally associated therewith.

Foam inhibitors form one type of inhibitor suitable for use as inhibitor components in the compositions of this invention. These include silicones, polyacrylates, surfactants, and the like.

Copper corrosion inhibitors constitute another class of additives suitable for inclusion in the compositions of this invention. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. Materials of these types that are available on the open market include Cobratec TT-100 and HiTEC® 314 additive and HiTEC® 4313 additive (Ethyl Petroleum Additives, Inc.). The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

Rust or corrosion inhibitors comprise another type of inhibitor additive for use in this invention. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Henkel Corporation. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; arnines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used.

Antioxidants may also be present in the lubricant formulations of the present invention. Suitable antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol). N,N'-di-sec-butyl-p-phenylenediamine, 4-isopropylaminodiphenyl amine, phenyl—naphthyl amine, phenyl—naphthyl amine, and ring-alkylated diphenylamines serve as examples of aromatic amine antioxidants. Most preferred are the sterically hindered tertiary butylated phenols, the ring alkylated diphenylamines and combinations thereof.

The amounts of the inhibitor components used will depend to some extent upon the composition of the component and its effectiveness when used in the finished composition. However, generally speaking, the finished fluid will typically contain the following concentrations (weight percent) of the inhibitor components (active ingredient basis):

| Inhibitor | Typical Range | Preferred Range |
|---|---|---|
| Foam inhibitor | 0 to 0.1 | 0.01 to 0.08 |
| Copper corrosion inhibitor | 0 to 1.5 | 0.01 to 1 |
| Rust inhibitor | 0 to 0.5 | 0.01 to 0.3 |
| Antioxidant | 0 to 1 | 0.1 to 0.6 |

Various types of sulfur-containing antiwear and/or extreme pressure agents can be used in the practice of the present invention. Examples include dihydrocarbyl polysulfides; sulfurized olefins; sulfurized fatty acid esters of both natural and synthetic origins; trithiones; sulfurized thienyl derivatives; sulfurized terpenes; sulfurized oligomers of $C_2$–$C_8$ monoolefins; and sulfurized Diels-Alder adducts such as those disclosed in U.S. Pat. No. Re 27,331. Specific examples include sulfurized polyisobutene, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl trisulfide, di-tert-butyl tetrasulfide and di-tert-butyl pentasulfide, among others. Combinations of such categories of sulfur-containing antiwear and/or extreme pressure agents can also be used, such as a combination of sulfurized isobutylene and di-tert-butyl trisulfide, a combination of sulfurized isobutylene and dinonyl trisulfide, a combination of sulfurized tall oil and dibenzyl polysulfide.

For purposes of this invention a component which contains both phosphorus and sulfur in its chemical structure is deemed a phosphorus-containing antiwear and/or extreme pressure agent rather than a sulfur-containing antiwear and/or extreme pressure agent.

Use can be made of a wide variety of phosphorus-containing oil-soluble antiwear and/or extreme pressure additives such as the oil-soluble organic phosphates, organic phosphites, organic phosphonates, organic phosphonites, etc., and their sulfur analogs. Also useful as the phosphorus-containing antiwear and/or extreme pressure additives that may be used in the present invention include those compounds that contain both phosphorus and nitrogen. Phosphorus-containing oil-soluble antiwear and/or extreme pressure additives useful in the present invention include those compounds taught in U.S. Pat. Nos. 5,464,549; 5,500,140; and 5,573,696, the disclosures of which are hereby incorporated by reference.

One such type of phosphorus- and nitrogen-containing antiwear and/or extreme pressure additives which can be employed in the practice of this embodiment of the invention are the phosphorus- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine. Other types of phosphorus- and nitrogen-containing antiwear and/or extreme pressure additive that may be used in the compositions of this invention include the amine salts of hydroxy-substituted phosphetanes or the amine salts of hydroxy-substituted thiophosphetanes and the amine salts of partial esters of phosphoric and thiophosphoric acids.

Some additive components are supplied in the form of solutions of active ingredient(s) in an inert diluent or solvent, such as a diluent oil. Unless expressly stated to the contrary, the amounts and concentrations of each additive component are expressed in terms of active additive, i.e., the amount of solvent or diluent that may be associated with such component as received is excluded.

Because of the excellent thermal and oxidative stability, wear control, low temperature viscometrics, copper corrosion control and compatibility with seal materials, the lubricating oil compositions of the present invention are particularly suitable for use as manual transmission oils and axle oils.

In an embodiment of the present invention, the lubricating oil composition is a manual transmission lubricating oil. A preferred manual transmission lubricating oil formulation contains a DI package comprising an ashless dispersant, at least one antioxidant and at least one inhibitor. Preferably, the DI package provides 0.2–5 wt % ashless dispersant(s) to the finished oil, 0–1.0 wt %, preferably from about 0.2–1.0 wt %, antioxidant(s) to the finished oil, and 0.01–2 wt % inhibitor(s) selected from the group consisting of copper corrosion inhibitors, rust inhibitors and mixtures thereof, to the finished oil. Preferably, the manual transmission lubricating oil formulation contains from 0–5 wt % sulfur and from 30 to 5000 ppm phosphorus, based on the total lubricating oil formulation.

In another embodiment of the present invention, the lubricating oil composition is an axle lubricating oil. A preferred axle lubricating oil formulation contains a DI package comprising an sulfur containing extreme pressure agent, at least one phosphorus containing anti-wear agent, at least one ashless dispersant and at least one inhibitor. More preferably, the DI package provides 3–15 wt % sulfur containing extreme pressure agent(s), 2–10 wt % phosphorus containing anti-wear agent(s), 0.2–5 wt % ashless dispersant(s) and 0.01–2 wt % inhibitor(s) selected from the group consisting of copper corrosion inhibitors, rust inhibitors and mixtures thereof, to the finished oil. Preferably, the axle lubricating oil formulation contains from 0.5–5 wt % sulfur and from 200 to 5000 ppm phosphorus, based on the total lubricating oil formulation.

Poly-α-olefins (PAOs) may be present in an amount of up to 40 percent by weight of the total lubricating oil composition. However, as a result of the excellent thermal and oxidative stability of the mineral oil based lubricants of the present invention, it is preferred that the lubricating oil compositions contain less than 10 weight percent, more preferably less than 5 weight percent, poly-α-olefins. In the most preferred embodiment, the lubricating oil compositions are free of poly-α-olefins.

Preferred formulated lubricant oils of the present invention utilize components proportioned such that the kinematic viscosity of the composition at 100° C. is at least 13.5 cSt, preferably at least 15.9 cSt. In a preferred embodiment of the present invention, the fully formulated oils have a maximum viscosity loss of 15% or less in the 20 hour tapered bearing shear test. The Tapered Bearing Shear Test is a published standard test entitled "Viscosity Shear Stability of Transmission Lubricants" and is described in CEC L-45-T-93 and is also published as DIN 51 350, part 6. When the formulated oils of the present invention are to be used as axle or manual transmission lubricants, it is preferred that the oils are formulated to have a Brookfield viscosity at −40° C. of less than 150,000 cP, preferably less than 130,000 cP.

EXAMPLES

The lubricating oil compositions of the present invention exhibit excellent thermal and oxidative stability. Table 1 demonstrates the unexpectedly superior thermal and oxidative stability obtained by using a base oil and VII mixture within the scope of the present claims. Table 1 shows the results of three formulated oils in the 300 hour L-60–1 test. The L-60–1 test determines the deterioration of lubricants under severe oxidation conditions. All of the oils contained 11 wt % of a DI additive package (including diluent oil), 9.5 wt % of a polyisobutylene having a number average molecular weight of 2100, 5.5 wt % of a polymethacrylate having a number average molecular weight of 38,000, 24 wt % of a 4 centistoke (cSt) PAO, 10 wt % of a 100 cSt PAO and 40 wt % of a mineral base oil. Three different mineral oils were tested and their physical properties are given in the footnote of Table 1.

TABLE 1

300 Hour L-60-1 Test Results

| Mineral Oil | KV (100° C.) | Sludge | Viscosity Increase (%) | Pentane Insolubles (%) | Toluene Insolubles (%) |
|---|---|---|---|---|---|
| A (Present Inv) | 14.60 | 9.75 | 83.91 | 0.17 | 0.01 |
| B (Comparative) | 15.03 | 9.44 | 103.26 | 0.22 | 0.08 |
| C (Comparative) | 14.92 | 9.36 | 117.29 | 0.20 | 0.14 |

Mineral Oil A: Viscosity Index (VI) of 115; aniline point of 113° C.; linear + single ring paraffin content of 73.9.
Mineral Oil B: Viscosity Index (VI) of 101; aniline point of 108° C.; linear + single ring paraffin content of 64.7.
Mineral Oil C: Viscosity Index (VI) of 100; aniline point of 107° C.; linear + single ring paraffin content of 62.3.

The lubricating oil formulated with a mineral oil within the scope of the present invention (Mineral Oil A) exhibited better oxidative and thermal stability as evidenced by the significantly lower increase in viscosity compared to the lubricating oils formulated with a mineral oil outside the scope of the present invention (Mineral Oils B and C).

Additional tests were carried out to show the thermal/oxidative stability of the lubricating oil compositions of the present invention. Three formulated lubricating oils were subjected to a temperature of 164° C. while being blown with 10.0 liters per hour of dry air for the time indicated in Table 2. These formulated oils differed only in the mineral base oil. The formulated oils are the same as described in Table 1. The percent viscosity increase as a function of time for each mineral base oil is given in Table 2.

TABLE 2

| Oxidative Stability Test - Percent Viscosity Increase | | | |
|---|---|---|---|
| Time (hours) | Mineral Oil A (Present Invention) | Mineral Oil B (Comparative) | Mineral Oil C (Comparative) |
| 0 | — | — | — |
| 96 | 21.8 | 25.6 | 27.1 |
| 144 | 29.0 | 36.2 | 39.6 |
| 240 | 67.5 | 93.7 | 114.1 |
| 287 | 114.1 | 200.9 | 283.0 |

It is clear from Table 2 that the mineral oil formulation of the present invention (A) exhibit unexpectedly improved thermal and oxidative stability compared to lubricating oil formulation containing mineral base oils outside the scope of the present claims (B and C) as evidenced by the much lower viscosity increase in the lubricating oil formulations containing mineral oil A.

A fully formulated lubricating oil containing mineral oil A, described above in the footnote of Table 1, and no PAO was tested in the 300 hour L-60–1 test. This fully formulated oil contained 18 wt % of a polyisobutylene having a number average molecular weight of 2100, 4.5 wt % of a polymethacrylate having a number average molecular weight of 38,000 and 5 wt % of a DI package. The DI package provided approximately 4 wt % of a phosphorus and boron containing succinimide dispersant to the finished oil, approximately 0.5 wt % of a mixture of hindered phenol and amine antioxidants to the finished oil and approximately 0.04 wt % of a thiadiazole corrosion inhibitor to the finished oil. The viscosity increase for the end of test oil was only 11% sludge and C/V ratings were 9.13 and 9.75 respectively. This oil is particularly suited for use as a manual transmission oil.

It is desired that lubricating oils, such as heavy-duty manual transmission oils be effective during the entire life in protecting yellow metals from corrosion, particularly copper, which is used in the form of coils in transmission coolers. Durability of corrosion inhibiting activity of the lubricant described above was demonstrated in ASTM D 130 Copper Corrosion Test. This test was run on both a fresh oil and an oil aged under a constant stream of air at 121° C. for 240 hours. A rating of 1b was obtained for both oils which indicates that the oil preserved its corrosion inhibition activity after being subjected to severe thermal and oxidative stress.

At numerous places throughout this specification, reference has been made to a number of U.S. Patents and published foreign patent applications. All such cited documents are expressly incorporated in full into this disclosure as if fully set forth herein.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

We claim:

1. A lubricating oil composition comprising:

(A) a mineral oil having a Viscosity Index of greater than 110, an aniline point of greater than 110° C. and a linear+single ring, paraffin content of 68% or greater;

(B) from about 0.1 to about 40 weight percent, based on the total weight of the lubricating oil composition, of at least one polymer selected from the group consisting of olefin (co) polymer(s), polyalkyl (meth) acrylate(s) and mixtures thereof;

(C) from 2 to 25 weight percent, based on the total weight of the lubricating oil composition, of a detergent/inhibitor package.

2. The lubricating oil composition of claim 1 comprising:

(A) a mineral oil having a Viscosity Index of greater than 110, an aniline point of greater than 110° C. and a linear+single ring paraffin content of 68% or greater;

(B) from about 0.1 to about 40 weight percent, based on the total weight of the lubricating oil composition, of a mixture of polymers comprising (b') at least one olefin (co) polymer and (b") at least one polyalkyl (meth) acrylate;

(C) from 2 to 25 weight percent, based on the total weight of the lubricating oil composition, of a detergent/inhibitor package.

3. The lubricating oil composition of claim 1 wherein (B) comprises at least one olefin (co) polymer having a number average molecular weight of from about 1,000 to about 10,000.

4. The lubricating oil composition of claim 2 wherein the olefin (co) polymer (b') has a number average molecular weight of from about 1,000 to about 10,000.

5. The lubricating oil composition of claim 3 wherein the olefin (co) polymer comprises at least one polyisobutylene.

6. The lubricating oil composition of claim 4 wherein the olefin (co) polymer (b') comprises at least one polyisobutylene.

7. The lubricating oil composition of claim 6 wherein the polyisobutylene has a number average molecular weight of from about 1,000 to about 3,000.

8. The lubricating oil composition of claim 4 wherein (b') and (b") are present in a ratio of b':b" of from 20:1 to 1:2.

9. The lubricating oil composition of claim 4 wherein the olefin (co) polymer (b') is present in an amount of from 12 to 20 weight percent, based on the weight of the total lubricating oil composition.

10. The lubricating oil composition of claim 1 wherein (B) comprises at least one polyalkyl (meth) acrylate having a number average molecular weight of from 10,000 to 250,000.

11. The lubricating oil composition of claim 2 wherein the polyalkyl (meth) acrylate (b") has a number average molecular weight of from 10,000 to 250,000.

12. The lubricating oil composition of claim 11 wherein the polyalkyl (meth) acrylate (b") is present in an amount of from 0.1 to 20 weight percent, based on the weight of the total lubricating oil composition.

13. The lubricating oil composition of claim 11 wherein the polyalkyl (meth) acrylate (b") is present in an amount of from 1 to 6 weight percent, based on the weight of the total lubricating oil composition.

14. A lubricating oil composition according to claim 1 containing less than 10 weight percent of a poly-α-olefin.

15. A lubricating oil composition according to claim 1 containing no poly-α-olefin(s).

16. A lubricating oil composition according to claim 1 having a kinematic viscosity at 100° C. of greater than 13.5 cSt.

17. A method of lubricating a manual transmission, said method comprises introducing into a manual transmission a lubricating oil composition comprising:

(A) From 40 to 93 weight percent of a mineral oil having a Viscosity Index of greater than 110; an aniline point of greater than 110° C. and a linear+single ring paraffin content of 68% or greater;

(B) from about 0.1 to about 40 weight percent, based on the total weight of the lubricating oil composition, of at least one polymer selected from the group consisting of olefin (co) polymer(s), polyalkyl (meth) acrylate(s) and mixtures thereof; and (C) from 2 to 25 weight percent, based on the total weight of the lubricating oil composition, of a detergent/inhibitor package, wherein the detergent/inhibitor package provides 0.2 to 5 wt % dispersant(s), 0 to 1.0 wt % antioxidant(s) and 0.01 to 2 wt % inhibitor(s) to the finished lubricating oil.

18. The method according to claim 17 wherein (B) comprises at least one olefin (co) polymer having a number average molecular weight of from about 1,000 to about 10,000.

19. The method according to claim 18 wherein the olefin (co) polymer comprises at least one polyisobutylene.

20. The method according to claim 19 wherein the polyisobutylene has a number average molecular weight of from about 1,000 to about 3,000.

21. The method according to claim 18 wherein the olefin (co) polymer comprises at least one ethylene-alpha-olefin copolymer.

22. The method according to claim 17 wherein (B) comprises at least one polyalkyl (meth) acrylate having a number average molecular weight of from 10,000 to 250,000.

23. The method according to claim 17 wherein component (B) comprises a mixture of polymers comprising (b') at least one olefin (co) polymer and (b") at least one polyalkyl (meth) acrylate.

24. The method according to claim 23 wherein the olefin (co) polymer (b') has a number average molecular weight of from about 1,000 to about 10,000.

25. The method according to claim 24 wherein the olefin (co) polymer (b') comprises at least one polyisobutylene.

26. The method according to claim 24 wherein the olefin (co) polymer (b') comprises at least one ethylene-alpha-olefin copolymer.

27. The method according to claim 27 wherein (b') and (b") are present in a ratio of b':b" of from 20:1 to 1:2.

28. The method according to claim 23 wherein the olefin (co) polymer (b') is present in an amount of from 12 to 20 weight percent, based on the weight of the total lubricating oil composition.

29. The method according to claim 23 wherein the polyalkyl (meth) acrylate (b") has a number average molecular weight of from 10,000 to 250,000.

30. The method according to claim 23 wherein the polyalkyl (meth) acrylate (b") is present in an amount of from 0.1 to 20 weight percent, based on the weight of the total lubricating oil composition.

31. The method according to claim 30 wherein the polyalkyl (meth) acrylate (b") is present in an amount of from 1 to 6 weight percent, based on the weight of the total lubricating oil composition.

32. The method according to claim 17 wherein the antioxidant(s) is present in the lubricating oil composition in an amount of from about 0.2 to about 1.0 wt %.

33. The method according to claim 32 wherein the antioxidant comprises at least one member selected from the group consisting of phenolic antioxidants, aromatic amine antioxidants, sulfurized phenolic antioxidants, organic phosphites and mixtures thereof.

34. The method according to claim 17 wherein the dispersant comprises at least one member selected from the group consisting of alkenyl succinimides, alkenyl succinic acid esters, alkenyl succinic ester-amides, Mannich bases, hydrocarbyl polyamines and polymeric polyamines.

35. The method according to claim 34 wherein the lubricating oil composition comprises at least one dispersant that has been phosphorylated, boronated or both phosphorylated and boronated.

36. A method of lubricating a vehicle axle, said method comprises introducing into the axle of a vehicle a lubricating oil composition comprising:

(A) from 40 to 93 weight percent of a mineral oil having a Viscosity Index of greater than 110, an aniline point of greater than 110° C. and a linear+single ring paraffin content of 68% or greater;

(B) from about 0.1 to about 40 weight percent, based on the total weight of the lubricating oil composition, of at least one polymer selected from the group consisting of olefin (co) polymer(s), polyalkyl (meth) acrylate(s) and mixtures thereof; and (C) from 2 to 25 weight percent, based on the total weight of the lubricating oil composition, of a detergent/inhibitor package, wherein the detergent/inhibitor package provides 3–15 wt % sulfur containing extreme pressure agent(s), 2–10 wt % phosphorus containing anti-wear agent(s), 0.2–5 wt % dispersant(s) and 0.01–2 wt % inhibitor(s) to the finished lubricating oil.

37. The method according to claim 36 wherein (B) comprises at least one olefin (co) polymer having a number average molecular weight of from about 1,000 to about 10,000.

38. The method according to claim 37 wherein the olefin (co) polymer comprises at least one polyisobutylene.

39. The method according to claim 38 wherein the polyisobutylene has a number average molecular weight of from about 1,000 to about 3,000.

40. The method according to claim 37 wherein the olefin (co) polymer comprises at least one ethylene-alpha-olefin copolymer.

41. The method according to claim 36 wherein (B) comprises at least one polyalkyl (meth) acrylate having a number average molecular weight of from 10,000 to 250,000.

42. The method according to claim 36 wherein component (B) comprises a mixture of polymers comprising (b') at least one olefin (co) polymer and (b") at least one polyalkyl (meth) acrylate.

43. The method according to claim 42 wherein the olefin (co) polymer (b') has a number average molecular weight of from about 1,000 to about 10,000.

44. The method according to claim 43 wherein the olefin (co) polymer (b') comprises at least one polyisobutylene.

45. The method according to claim 43 wherein the olefin (co) polymer (b') comprises at least one ethylene-alpha-olefin copolymer.

46. The method according to claim 42 wherein (b') and (b") are present in a ratio of b':b" of from 20:1 to 1:2.

47. The method according to claim 42 wherein the olefin (co) polymer (b') is present in an amount of from 12 to 20 weight percent, based on the weight of the total lubricating oil composition.

48. The method according to claim 42 wherein the polyalkyl (meth) acrylate (b") has a number average molecular weight of from 10,000 to 250,000.

49. The method according to claim 42 wherein the polyalkyl (meth) acrylate (b") is present in an amount of from 0.1 to 20 weight percent, based on the weight of the total lubricating oil composition.

50. The method according to claim 49 wherein the polyalkyl (meth) acrylate (b") is present in an amount of from 1 to 6 weight percent, based on the weight of the total lubricating oil composition.

* * * * *